US007762629B2

(12) United States Patent
De Ruiter

(10) Patent No.: US 7,762,629 B2
(45) Date of Patent: Jul. 27, 2010

(54) SEATING OR RECLINING FURNITURE

(75) Inventor: Hugo De Ruiter, Eindhoven (NL)

(73) Assignee: De Sede AG, Klingnau (CH)

( * ) Notice: Subject to any disclaimer, the term of this patent is extended or adjusted under 35 U.S.C. 154(b) by 718 days.

(21) Appl. No.: 10/583,522

(22) PCT Filed: Dec. 19, 2003

(86) PCT No.: PCT/CH03/00837

§ 371 (c)(1),
(2), (4) Date: Mar. 16, 2007

(87) PCT Pub. No.: WO2005/058097

PCT Pub. Date: Jun. 30, 2005

(65) Prior Publication Data

US 2007/0176468 A1 Aug. 2, 2007

(51) Int. Cl.
*A47C 7/46* (2006.01)

(52) U.S. Cl. ..... 297/284.1; 297/383

(58) Field of Classification Search ..... 297/383, 297/353, 283.3, 284.1, 284.3, 452.29, 185, 297/115

See application file for complete search history.

(56) References Cited

U.S. PATENT DOCUMENTS

| | | | | |
|---|---|---|---|---|
| 2,145,201 | A * | 1/1939 | Raeuber | 297/142 |
| 3,905,642 | A * | 9/1975 | Simjian | 297/185 |
| 4,195,882 | A * | 4/1980 | Daswick et al. | 297/242 |
| 4,865,387 | A * | 9/1989 | Lipparini et al. | 297/378.1 |

FOREIGN PATENT DOCUMENTS

| | | |
|---|---|---|
| JP | 50-170664 | 12/1975 |
| JP | 04-049968 | 7/1992 |

* cited by examiner

*Primary Examiner*—Milton Nelson, Jr.
(74) *Attorney, Agent, or Firm*—Olson & Cepuritis, Ltd.

(57) ABSTRACT

This invention relates to seating or reclining furniture. A back rest or arm rest is disposed for adjustment on the seating and/or reclining surface. The back rest or arm rest may be positioned in different areas of the circumference of the furniture (e.g., sofa) and can bend along the adjustment path so that they can adapt to the shape of the circumference, i.e., the contour of the circumference of the seating and/or reclining surface.

21 Claims, 4 Drawing Sheets

SEATING OR RECLINING FURNITURE

This application is the National Stage of International Application No. PCT/CH2003/00837 filed Dec. 13, 2003, which is incorporated herein by reference.

BACKGROUND OF THE INVENTION

1. Field of the Invention

The invention relates to furniture having a seating and/or reclining surface and at least one back rest or arm rest connected to the former and adjustable with respect to the seating and/or reclining surface such that it can be positioned in various circumferential areas of the seating and/or reclining surface.

2. Description of the Related Art

WO 03/030689 describes a sofa in which one or more back rest are adjustable along a rail in the form of an arc of a circle. European Patent 309 021 A also describes a sofa having various individual back rests that can be positioned. German Utility Model DE-U-20217809 describes a single pivotable back rest on a sofa which can be positioned and moved along a rail, for example. U.S. Patent A-2003/0061655 describes a sofa or bed having a pivotable back rest, optionally positionable on one or the other longitudinal side. German Utility Model DE-U-8901762 describes a sofa having two pivotable rigid back rest parts which are designed so they are adapted in shape to the seating surface which is in the form of an arc of a circle in part and can be positioned on it in various positions. Therefore the seating options can be altered by 180°. Finally, German Utility Model DE-U-9404758 discloses a sofa having a stationary back rest to which cushions can be attached adjustably.

SUMMARY OF THE INVENTION

The object of the present invention is to improve upon seating or reclining furniture having a back rest that can be positioned variably.

This is accomplished with furniture of the type defined in the preamble, having the characterizing features of claim 1.

Due to the fact the at least one back rest or arm rest is designed to be articulated and/or flexible itself so that it adapts in a controlled manner to the seating surface when positioned along same, largely any shape of the seating surface may be selected and nevertheless the back rest can be positioned at any point on the seating and/or reclining surface. The restriction to contours of the starting surface having a simple arc shape is eliminated, and the circumference thereof may have concave or convex sections where the back rest or arm rest can be positioned.

In a preferred embodiment, the seating surface then has both concave and convex sections of the circumferential contour and the back rest(s) is/are preferably positionable along the entire circumference of the seating surface and/or reclining surface. It is thus possible to create a sofa with a direction of seating that differs by 180° and with a different shape of the free seating surface. The back rest preferably extends beneath the seating surface. It is likewise preferable if the back rest covers the end face of the seating surface, in particular covering it completely. In this way, the control means which control the bending movement of the back rest can be designed so they are not visible. In particular, this is also the case when the control means are arranged beneath the seating surface. Preferably at least one rail is provided as the control means on which at least two carriages per back rest can be moved on the rail by sliding or rolling them and are connected to the back rest. The control means are preferably designed so that they not only control the bending movement of the back rest in the movement of same but also carry the back rest and support it against the forces that occur when a user of the furniture reclines against the back rest. Furthermore, each back rest is preferably formed by five or seven elements.

BRIEF DESCRIPTION OF THE DRAWINGS

Exemplary embodiments of the present invention are explained in greater detail below on the basis of the drawings, in which.

DESCRIPTION OF THE PREFERRED EMBODIMENT

In the present patent application, preferred embodiments of the present invention are described, but it should be pointed out clearly that the present invention is not limited to these embodiments and may also be embodied in other ways within the scope of the following patent claims.

Figure 1:
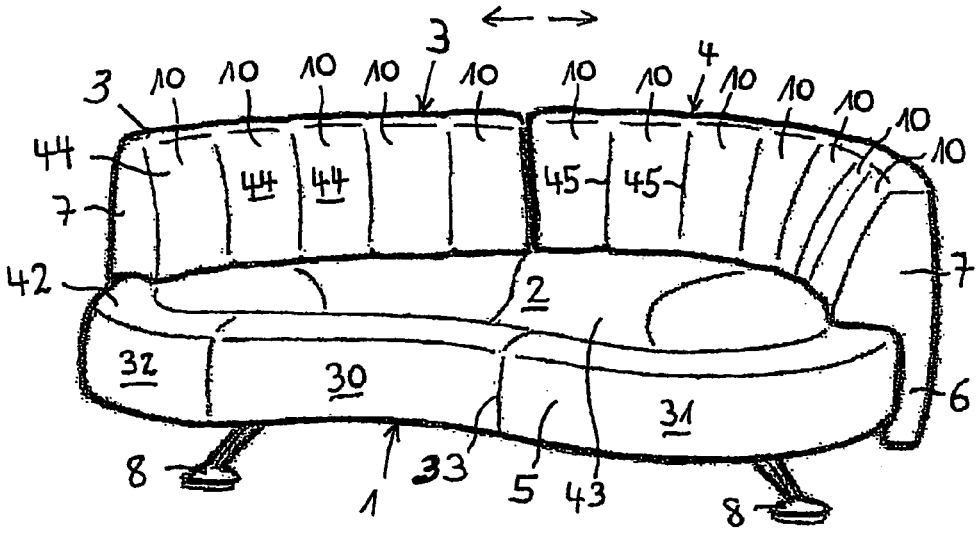
FIG. 1 shows a view of an item of furniture designed as a sofa according to this invention having two back rests.
Figure 2:
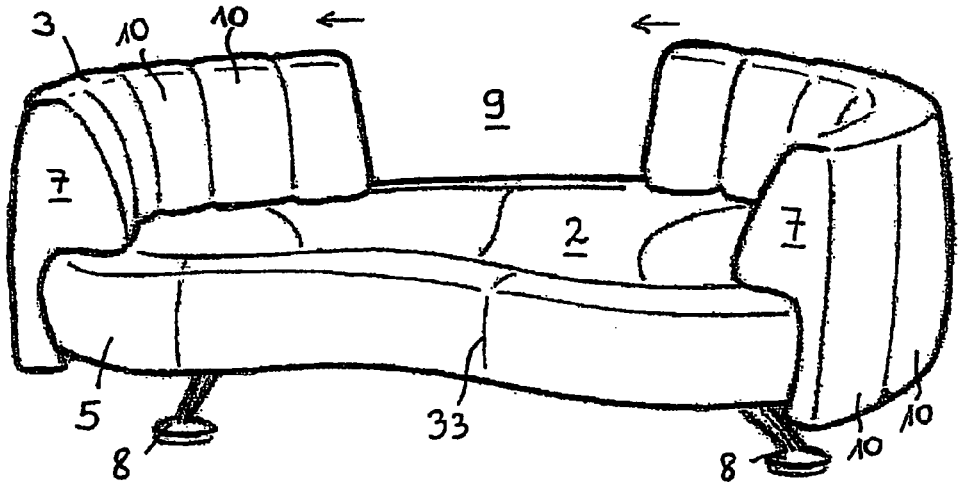
FIG. 2 shows the furniture from FIG. 1 with back rest positioned in various positions with respect to FIG. 1.
Figure 3:
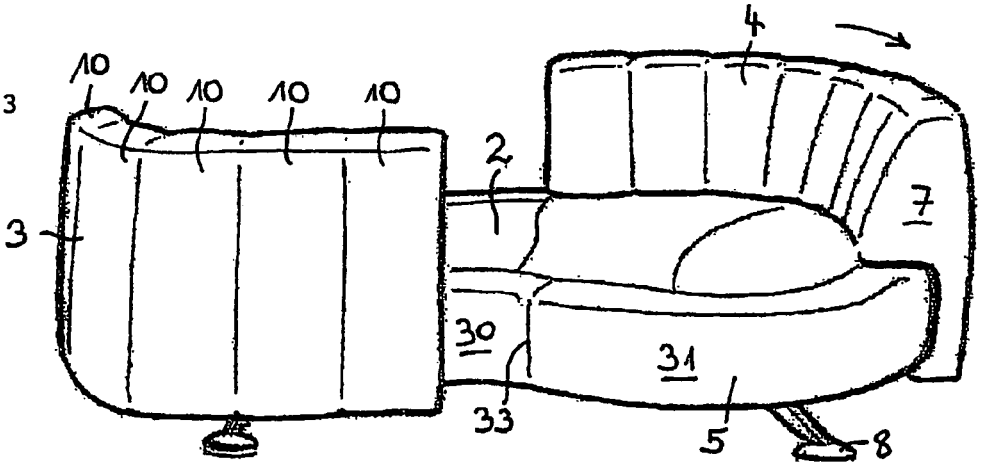
FIG. 3 shows the furniture from FIG. 1 and/or FIG. 2 with the back rests positioned in various additional positions.

FIGS. 1 through 3 show schematic diagrams of one embodiment of inventive seating or reclining furniture as a sofa. This is a preferred embodiment; embodiments as strict reclining furniture (bed) or as a smaller item of seating furniture which does not allow reclining because of the size are also possible. The sofa 1 shown here has a seating surface 2 which rests on a supporting frame with the feet 8. In the example shown here, two back rests 3 and 4 are provided, but this should be understood only as an example because only one back rest or more than two back rests could also be possible. According to this invention, the back rest may be positioned in different areas of the circumference 5 of the sofa, and they bend along the adjustment path so that they adapt to the shape of the circumference, i.e., the contour of the circumference of the seating and/or reclining surface. This is readily visible in FIGS. 1 through 3 where the back rests 3, 4 are shifted from the position shown in FIG. 1 in the direction of the arrows shown there, the back rest 3 bending according to the highly curved circumferential contour of section 32 of edge 5 and adapting to the shape of the seating and/or reclining surface accordingly. The same thing also occurs with the back rest 4 which adapts to the less curved but also convex circumferential contour of section 31 of the edge. From the position of the back rest in FIG. 2, they are then moved in the direction of the arrows in FIG. 2, so the back rest 4 is moved back into the position illustrated in FIG. 3 and the back rest 3 is moved further along the circumference 5 and into the concave area 30 of the circumference and also adapts to same. The positions for the back rest shown here are of course to be understood only as examples and preferably any back rest may be completely moved around the seating and/or reclining surface 2 and adapts to the circumferential contour along the entire path of travel of same. For example, starting from FIG. 3, the back rest 4 could again be moved according to the arrow shown in FIG. 3 until it is abutting against the back rest 3, so that the result is again a sofa having a self-contained continuous back rest like that illustrated in FIG. 1 but with the seat position different by 180° because the back rest have also been moved into a position that is different by 180°. It is also possible to limit the path of travel of one or more back rest, but, as mentioned, it is preferable to move the back rest completely around the seating and/or reclining surface. An embodiment in which one or more back rest is in a fixed position and only one or more other back rest can be moved, adapting to the circumferential contour, is also possible.

The back rest preferably consist of several elements 10 that are joined together in an articulated fashion and are adapted to the circumferential contour when moved along said contour by control means.

Figure 4:
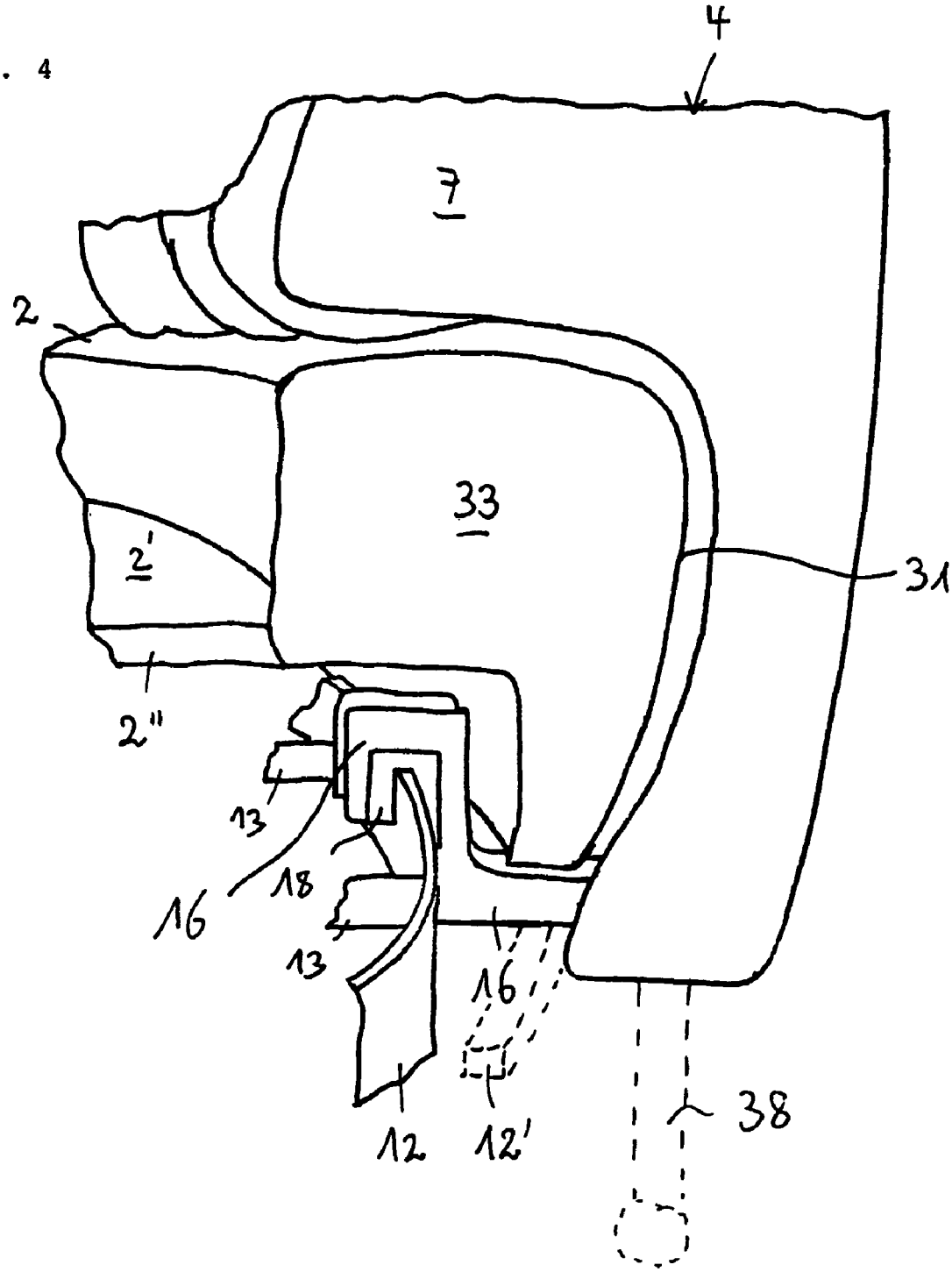
FIG. 4 shows a simplified side view of a back rest and part of a seating surface and a rail and a carriage as the control means.

FIG. 4 shows a schematic sectional diagram of part of the exemplary embodiment that has already been explained with reference to FIGS. 1 through 3; the view here illustrates the area between the sections 30 and 31 of the seating and/or reclining surface 2. It can thus be seen here that this surface 33 is part of the upholstered edge 42 of the seating and/or reclining surface 2. The internal padding 43 is not shown in FIG. 4 and would be situated in the recess 2' on a board 2". The back rest 4, which is shown only partially here, has been moved up to the surface 33 in this view and can be seen with its side surface 7. The back rest 4 preferably extends over the seating and/or reclining surface 2 and in particular over its edge 42, so that the latter is covered by the back rest. It is also preferable if the back rest also covers the circumferential surface 5 of the seating and/or reclining surface 2 so that this can be seen only where the back rests are not located. As diagrammed schematically in FIG. 4, the back rest 4 is now attached to the carriage 16, only one of which is illustrated in FIG. 4, said carriages 16 being movable by sliding or rolling on a rail 12 so that by means of this movement of the carriages, the shape of the rail is impressed upon the back rest and/or the back rest is curved according to the shape of the rail so that the rail 12 and the respective carriages in this example are the controlling means for influencing the bending of the particular back rest.

Figure 5:
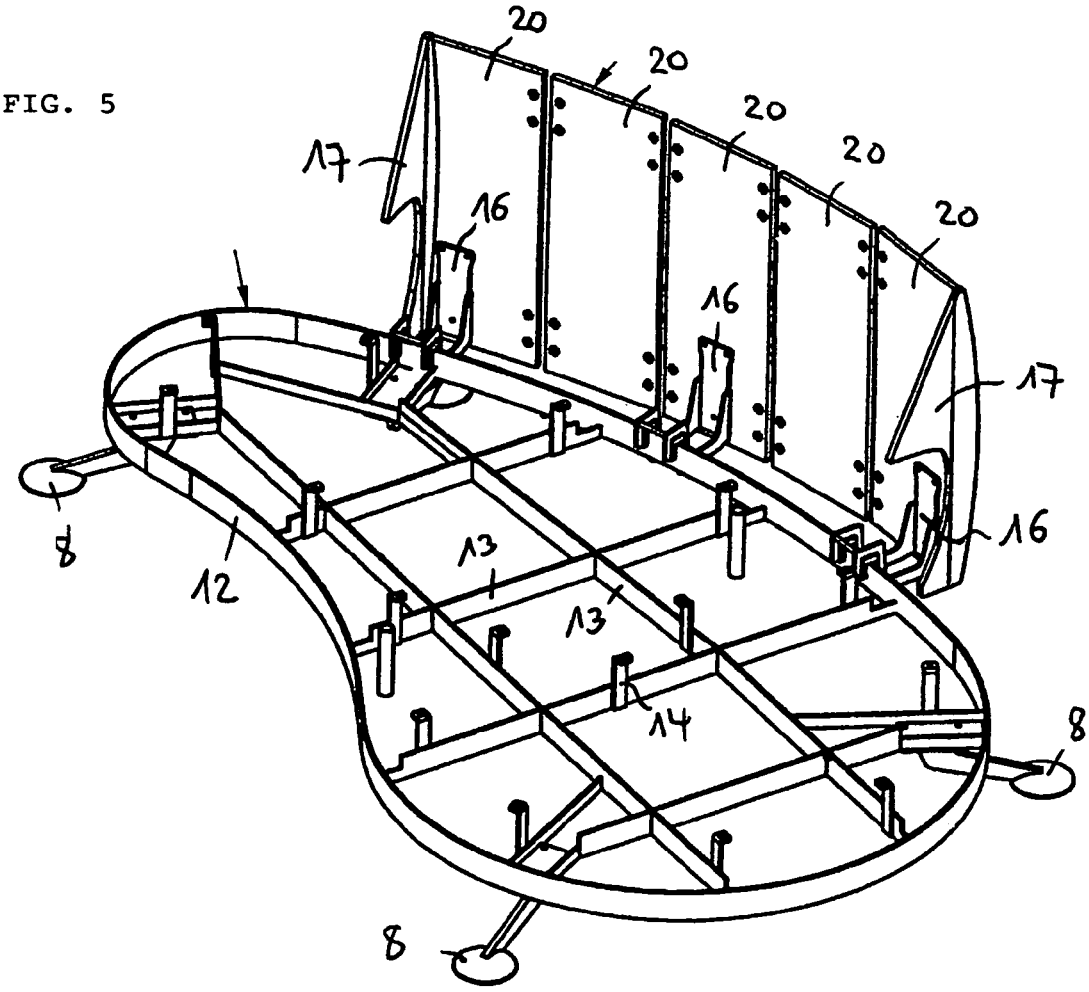
FIG. 5 shows a schematic view of the design of a sofa with a rail and a back rest that can move along this rail.
Figure 6:
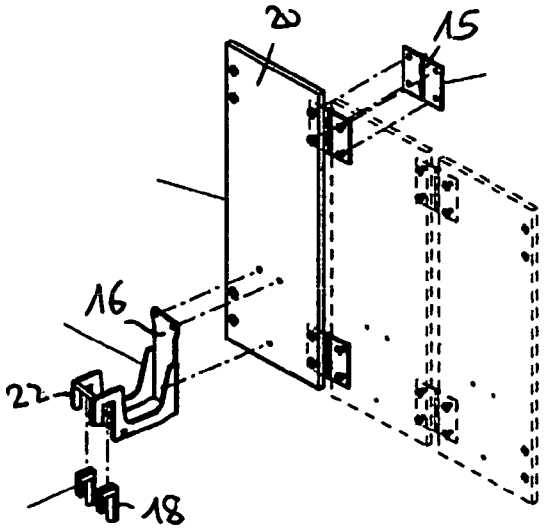
FIG. 6 shows a diagram of part of the back rest.
Figure 7:
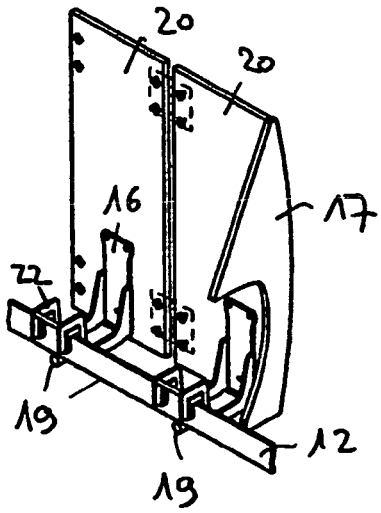
FIG. 7 shows part of the back rest and the control means.
Figure 8:
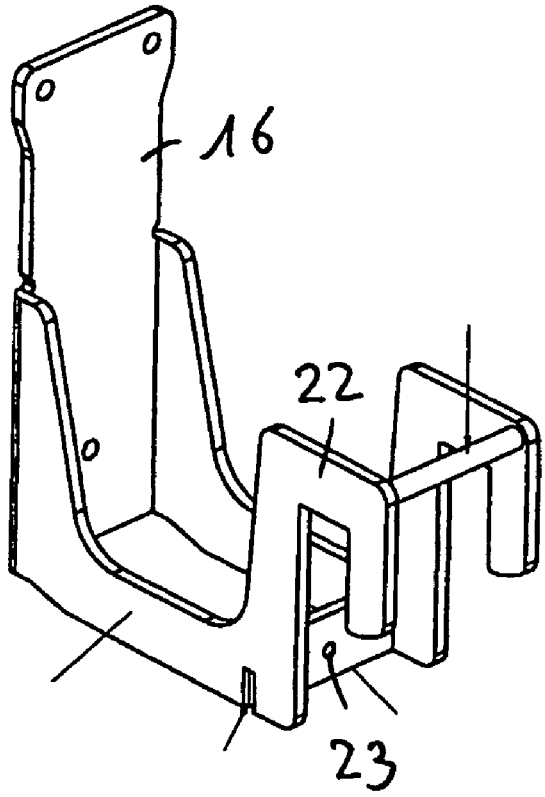
FIG. 8 shows a carriage.
Figure 9:
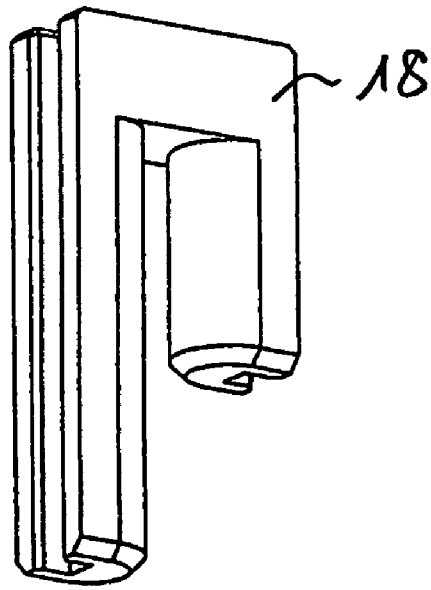
FIG. 9 shows a sliding and supporting piece for the carriage from FIG. 8.

FIGS. 5 through 9 show a corresponding preferred design of the furniture in greater detail. FIG. 5 shows the bottom frame of the furniture in which the rail 12 extends completely around the bottom frame as a self-contained rail and at the same time forms a load-bearing element of same. This is a preferred embodiment. The rail 12 may in the meantime also be a separate element which is attached on or to another load-bearing element of the lower frame. If only partial mobility of the back rest(s) is desired, then the rail need not be self-contained and may extend over only the desired parts of the traversing path. FIG. 5 in turn shows the shaping of the rail with the various convex sections and the one concave section. This shaping is of course to be understood only as an example. The inventive flexibility of the back rest allows fundamentally free shaping as part of the possible flexibility of the back rest. This in turn depends on the number and width of elements joined together in an articulated fashion or the flexibility of a flexible element, which is explained below. The lower frame of the furniture in the exemplary embodiment shown here consists not only of the rail but also the struts 13 which are attached to the rail and the bars 14 which extend upward for the seating and/or reclining surface 2 and/or the board 2" thereof. In addition, the feet 8 are attached to the lower frame. FIG. 5 shows the construction of the one back rest 3, which consists of five rigid elements 20 which are joined together so they can move with hinges 15 in an articulated manner with respect to one another as depicted in greater detail in FIG. 6, which shows one of the hinges in the a position in which it is raised by the elements 20. The hinge 15 (which may also be replaced by other known means for articulated connection) makes it possible to position the rigid back rest 20 of the rest 30 at an angle to one another so that the back rest 3 can adapt to the shape of the rail 12 shown here and thus to the circumferential contour of the seating and/or reclining surface as well. This means that the shape of the contour of the rail 12 will usually be the same as the circumferential contour of the seating and/or reclining surface. If desired, however, the shape of the rail may also deviate from the shape of the seating and/or reclining surface 2 so the back rest is adapted approximately to the shape of the seating surface only in certain locations. Due to the preferred coverage of the seating surface 2 by the back rest, as shown primarily here, there is nevertheless no unwanted hole between the seating surface 2 and the back rest.

FIG. 5 and the following figures also show the carriages 16 which are attached to the rigid back rest parts 20 and extend over the rail 12 with their other hook-shaped ends 22. As a rule, at least three carriages 16 are provided per back rest, namely one at each end and in the center so that the control means formed by the rail 12 and the carriages 16 are able to bend and/or adjust in an articulated manner the back rest following the rail as accurately as possible. More carriages may optionally also be provided, e.g., a separate carriage for each part 20. The back rest 3 shown in FIG. 5 has five parts 20 having a back rest 4 (not shown here) and seven parts 20 and/or elements 10, as shown in FIGS. 1 through 3. As a rule, the number of elements 10 on the furniture matches the number of elements 20. In FIG. 5 it can also be seen that the two parts 20 which form the end areas of the back rest are provided with side parts 17 which form the side faces 7 of the respective back rest after appropriate upholstering and covering with an upholstery material. In addition to the rigid back rest parts 20 shown here, each back rest of course also has padding and an upholstery material which form a convenient back rest in the known manner. The upholstery may be provided in one piece for the respective back rest and must of course have some elasticity and must be compressible so that the padding can follow the movement of the rigid parts 20 produced by the control means. The padding may also include a plurality of individual parts and may have a single upholstery part for each back rest 20. The upholstery material may be selected according to the one-piece or multi-piece upholstery. The individual upholstery parts 44 are preferably partially separated from one another by appropriate seams 45 or stitching (FIG. 1) and may also be visually separate parts.

The rigid parts 20 thus form a back rest that essentially does not yield when one person rests against it and/or a back rest which yields only due to its padding.

Instead of or in combination with the plurality of rigid parts 20 joined together in an articulated fashion, one or more flexible back rest parts may also be used, these parts being flexible in the direction of movement but as a rigid as possible with respect to the forces occurring when a person rests against the back rest. Corresponding back rest parts may be made of plastic and/or composite materials or metal. Instead of the control means shown here with the rail and carriages, it is of course also possible to have the back rest guided and/or controlled by a rod design having varying lengths of the rods. The rod length is adjusted, for example, by one or more control curves so that it is also possible to control the shape of the back rest according to the circumferential contour of the seating and/or reclining surface 2 in such a manner.

FIGS. 6 through 9 show how a carriage 16 which is made of a metal part, for example, is attached to the rigid part 20 and how sliding parts 18 made of POM plastic are preferably arranged on the holding parts 22 of the carriages extending over the rail 12. A securing part, which is also designed as a plastic sliding part and which extends beneath the rail, may be attached to a fastening point 23 on the carriage so that the back rest is secured against removal of the rail. Instead of sliding parts, rollers or balls may also be provided.

In the embodiment shown here, the carriages 16 of the control means together with the rail 12 at the same time form the support for the back rest 3, 4 against the forces acting on them when a person leans against them. However, this function may also be separated from the control function, as indicated in FIG. 4 with the rail 12' which, as an additional separate rail, would assume the function of supporting the back rest, so that the rail 12 only fulfills the control function. Another possible solution for this support is to provide feet 38 on the back rest, which are supported on the surface on which the sofa stands by means of spherical rollers, for example. Again in this case, the rail 12 would fulfill only the control function and the support would be provided by multiple feet 38 per back rest. Meanwhile the combined function of the rail 12 and the carriages 16 as control means and as supporting means for the back rest is preferred.

Of course the preferred arrangement of the control means shown here, i.e., the rail 12 beneath the seating surface shown in this example is to be understood only as an example. Control means could also be provided in the form of a rail on the circumferential surface 5 of the seating and/or reclining surface. The control means could also be arranged on the top side of the edge 42 of the seating surface 2, e.g., in the form of a groove-shaped hollow rail in which journals of the back rest engage, said journals protruding from the bottom side of the back rest that covers the seating surface 2. In the latter two cases, however, the control means, e.g., in the form of the abovementioned rails, are visible where the back rests are not located so that it must be embodied as a design element of the furniture accordingly.

The invention has been explained on the basis of back rest. Instead of or in addition to back rest, however, one or more arm rests may also be designed and provided according to this invention.

While I have shown a presently preferred embodiment of the invention, it will be apparent to persons skilled in the art that the invention may be otherwise embodied within the scope of the following claims.

I claim:

1. Furniture (1) having a seating surface (2) and at least one support rest (3, 4) connected to the former and adjustable with respect to the seating surface such that it can be positioned in various circumferential areas of the seating surface, characterized in that at least one support rest (3, 4) is formed from a plurality of elements (10) that are connected in an articulated fashion and that are flexible in the direction of movement along an adjustment path and control means (12, 16, 18) for causing the elements to bend along the adjustment path such that the support rest adapts itself generally to the circumferential contour of the seating surface (2) along at least a part of the adjustment path.

2. Furniture according to claim 1, characterized in that the support rest includes at least one back rest (3, 4) that partially covers the seating surface (2).

3. Furniture according to claim 1, characterized in that the support rest includes at least one back rest that can be selectively positioned along the circumference of the seating surface.

4. Furniture according to claim 1, characterized in that there are two support rests comprising two separately positional back rests (3, 4).

5. Furniture according to claim 1, characterized in that the support rest comprises at least one back rest (3, 4) that is formed from separate rigid parts (20) which are connected together in an articulated fashion by hinges (15) in the adjustment direction and each forms an element (10) covered with upholstery, whereby the at least one back rest (3, 4) is formed by at least five elements (10).

6. Furniture according to claim 5, characterized in that the at least one back rest (3, 4) is formed by seven elements (10).

7. Furniture according to claim 1, characterized in that the seating surface includes a circumferential surface (5) and the support rest includes at least one back rest (3, 4) that covers the circumferential surface (5) of the seating surface.

8. Furniture according to claim 1, characterized in that the control means (12, 16, 18) are arranged generally below the seating surface.

9. Furniture according to claim 1, characterized in that the control means also support the support rest (3, 4) and support it against forces that occur when a user sitting on the seating surface (2) leans against it.

10. Furniture according to claim 1, characterized in that the control means include a rail (12) which determines a desired shape of bending of the support rest (3, 4).

11. Furniture according to claim 10, characterized in that the support rest includes a back rest having a side face with a circumferential contour and the rail (12) has generally the same contour as the circumferential contour of the side face and is a self-contained rail.

12. Furniture according to claim 10, characterized in that the seating surface includes understructure and the rail (12) is part of the understructure of the seating surface and forms the base of the furniture with struts (13).

13. Furniture according to claim 12, characterized in that the control means comprise multiple carriages (16) which can be moved by sliding or rolling on a rail (12) for each support rest.

14. Furniture according to claim 13, characterized in that the carriages include on both sides of the rail and above the rail, plastic sliding parts (18) in contact with the rail and another sliding plastic part (19) which reaches beneath the rail.

15. Furniture according to claim 1, characterized in that the seating surface (2) has a circumferential contour (30, 31, 315) that is both concave and convex.

16. Furniture according to claim 15, characterized in that there are two support rests (3, 4) comprising two separately positional back rests.

17. Furniture according to claim 15, characterized in that the support rest comprises at least one back rest (3, 4) that is formed from separate rigid parts (20) which are connected together in an articulated fashion by hinges (15) in the adjustment direction and each forms an element (10) with upholstery, whereby the at least one back rest (3, 4) is formed by at least five elements (10).

18. Furniture according to claim 15, characterized in that the support rest includes at least one back rest (3, 4) that partially covers the seating surface (2).

19. Furniture according to claim 15, characterized in that the seating surface includes a circumferential surface (5) and the support rest includes at least one back rest (3, 4) that covers the circumferential surface (5) of the seating surface.

20. Previously Presented) Furniture according to claim 15, characterized in that the control means (12, 16, 18) are arranged generally below the seating surface.

21. Furniture according to claim 15, characterized in that the support rest comprises at least one back rest that can be positioned selectively along the circumference of the seating surface.

* * * * *

UNITED STATES PATENT AND TRADEMARK OFFICE

CERTIFICATE OF CORRECTION

PATENT NO. : 7,762,629 B2
APPLICATION NO. : 10/583522
DATED : July 27, 2010
INVENTOR(S) : Hugo De Ruiter It is certified that error appears in the above-identified patent and that said Letters Patent is hereby corrected as shown below:

Col. 5, line 7, after "part" insert -- 19 --.

Col. 5, line 9, "23" should be -- 63 --.

Claim 15, Col. 6, line 52, "315" should be -- 32 --.

Claim 20, Col. 7, line 5, "Previously presented)" should be deleted.

Signed and Sealed this

Ninth Day of November, 2010

David J. Kappos

David J. Kappos
*Director of the United States Patent and Trademark Office*